US005092737A

United States Patent [19]

Lau

[11] Patent Number: 5,092,737

[45] Date of Patent: Mar. 3, 1992

[54] BLADE TIP CLEARANCE CONTROL ARRANGEMENT FOR A GAS TURBINE

[75] Inventor: Kwok Y. Lau, Derby, England

[73] Assignee: Rolls-Royce plc, London, United Kingdom

[21] Appl. No.: 737,906

[22] Filed: Jul. 26, 1991

Related U.S. Application Data

[63] Continuation of Ser. No. 459,341, Dec. 29, 1989, abandoned.

[30] Foreign Application Priority Data

Feb. 10, 1989 [GB] United Kingdom ..... 8903000

[51] Int. Cl.[5] ..... F01D 5/20

[52] U.S. Cl. ..... 415/173.2; 415/12

[58] Field of Search ..... 415/173.1, 173.2, 173.3, 415/173.6, 174.2, 177, 200, 216.1, 12

[56] References Cited

U.S. PATENT DOCUMENTS

| | | | |
|---|---|---|---|
| 1,483,298 | 2/1924 | Girin | 415/216.1 |
| 2,304,259 | 12/1942 | Karrer | 415/216.1 |
| 3,146,992 | 9/1964 | Farrell | 415/12 |
| 4,169,726 | 10/1979 | Fairbanks | 415/173.1 |
| 4,522,559 | 6/1985 | Burge et al. | 415/177 |
| 4,551,064 | 11/1985 | Pask | 415/173.1 |
| 4,659,282 | 4/1987 | Popp | 415/200 |
| 4,875,828 | 10/1989 | Willkop et al. | 415/177 |

FOREIGN PATENT DOCUMENTS

| | | | |
|---|---|---|---|
| 2422533 | 5/1974 | Fed. Rep. of Germany . | |
| 0932045 | 3/1948 | France | 415/173.1 |
| 2554563 | 6/1976 | Netherlands | 415/173.2 |
| 148428 | 7/1974 | United Kingdom . | |
| 148936 | 12/1974 | United Kingdom . | |
| 2087979 | 11/1980 | United Kingdom . | |
| 2076067 | 11/1981 | United Kingdom . | |
| 2195715 | 8/1986 | United Kingdom . | |
| 2206651 | 1/1987 | United Kingdom . | |

*Primary Examiner*—Edward K. Look
*Assistant Examiner*—Christopher M. Verdier
*Attorney, Agent, or Firm*—Cushman, Darby & Cushman

[57] ABSTRACT

A blade tip clearance control arrangement for a compressor of a gas turbine engine comprises a first annular control member which defines a portion of the gas flowpath through the compressor and which is spaced from the tips of the rotor blades by a clearance. The first annular control member is positioned coaxially inwardly of a pair of second annular control members and is secured thereto by a radially resilient annular support member.

The first annular control member is formed from a relatively low expansion material and the second annular control members are formed from a relatively high expansion material. Initially the first annular control member expands rapidly in accordance with its own rate of thermal expansion against the resilience of the resilient annular support member, and the first annular control member is caused to expand beyond its fully thermally expanded state by the second annular control members and the resilient annular support member in accordance with the rate of thermal expansion of the second annular control members.

24 Claims, 4 Drawing Sheets

BLADE TIP CLEARANCE CONTROL ARRANGEMENT FOR A GAS TURBINE

This is a continuation of application Ser. No. 4,594,341, filed on Dec. 29, 1989, which was abandoned upon the filing hereof.

The present invention relates to a blade tip clearance control arrangement for a gas turbine engine.

BACKGROUND OF THE INVENTION

In a typical gas turbine engine component efficiencies depend increasingly on the clearance between the rotating rotor blades and the annular member, or members, defining the outer gas flowpath. The casing arrangements which form the annular member or members, must ideally have a thermal responsive characteristic matching the growth of the rotor. The rotor growth is characterised by an initial fast centrifugal growth element superimposed on a slower thermal rotor growth element. Furthermore the thermal rotor growth element at the rim of the rotor is a resultant thermal strain between principally the rotor rim and the rotor cob. Due to its direct contact with the main gas stream, the rotor rim has a fast thermal growth rate. The rotor cob however is much slower in its thermal growth rate. Hence the rotor radial displacement profile can be regarded as a multi-rate system responsive to changes in the gas turbine engine conditions.

Many blade tip clearance control arrangements have attempted to match the rotor growth by using several design principles. A first arrangement has used a fast response casing arrangement in which a high thermal expansion material gives a large range of radial displacements. A second arrangement has a slow response casing arrangement in which a low thermal expansion material gives a small range of radial displacements. A third arrangement uses a combination of the first and second arrangements and our UK patents GB1484288, GB1484936 and GB2087979B are examples.

Unfortunately these blade tip clearance control arrangements have failed to produce the ideal solution, as they are essentially single rate thermal systems because small blade tip clearances are achieved at certain engine operating conditions at the expense of other engine operating conditions.

SUMMARY OF THE INVENTION

The present invention seeks to provide an improved blade tip clearance control arrangement for a gas turbine engine.

Accordingly the present invention provides a blade tip clearance control arrangement for a gas turbine engine comprising a rotor and a stator, the rotor having at least one stage of circumferentially arranged radially extending rotor blades, the stator comprising a first annular control member having a relatively rapid response rate such that it expands or contracts quickly in accordance with a temperature variation, the first annular control member being formed from a relatively low expansion material, the first annular control member being spaced radially from the blade tips by a clearance and defining a portion of the flowpath through the gas turbine engine, at least one second annular control member having a relatively slow response rate such that it expands or contracts slowly in accordance with a temperature variation, the second annular control member being formed from a relatively high expansion material, the first annular control member being supported coaxially from and radially inwardly of the second annular control member by a radially resilient annular support member whereby the first annular control member initially expands relatively rapidly in a first phase of thermal expansion in accordance with the rate of expansion of the first annular control member against the combined resilience of the resilient annular support member and the second annular control member until the first annular control member is fully thermally expanded, the first annular control member is caused to expand relatively slowly in a second phase of thermal expansion in accordance with the rate of expansion of the second annular control member by the resilience of the resilient annular support member, the first annular control member initially contracts relatively rapidly in a first phase of thermal contraction in accordance with the rate of contraction of the first annular control member against the combined resilience of the resilient annular support member and second annular control member, the first annular control member is caused to contract relatively slowly in a second phase of thermal contraction in accordance with the rate of contraction of the second annular control member by the resilience of the resilient annular support member.

Preferably two second annular control members are axially spaced, the first annular control member is supported coaxially from and radially inwardly of second annular control members by the radially resilient annular support member, the axial ends of the resilient annular support member are secured to the second annular control members, the first annular control member is connected to the resilient annular support member by connection means substantially at the mid portion of the resilient annular support member.

The first annular control member, the resilient annular support member and the connection means may be formed integrally.

The rotor may comprise a plurality of axially spaced stages of rotor blades, the stator comprises a plurality of first annular control members each one of which is spaced radially from the blade tips of a respective one of the stages of rotor blades by a clearance, a plurality of second annular control members, each first annular control member is supported coaxially from and radially inwardly of a pair of second annular control members by a respective resilient annular support member, the axial ends of each resilient annular support member are secured to the respective pair of second annular control members, each first annular control member is connected to the respective resilient annular support member by connection means substantially at the mid portion of the resilient annular support member.

The axially upstream second annular control member of at least one pair of second annular control members may be secured to the axially downstream second annular control member of the pair of second annular control members axially adjacent in an upstream direction by an annular casing member such that the second annular control members, the resilient annular members and the annular casing member define a stator casing.

A stage of stator vanes may be positioned axially between adjacent stages of rotor blades, each stage of stator vanes being secured at their upstream end and downstream end to first annular control members.

The second control member may be insulated.

The rotor may be a turbine rotor.

The rotor may be a compressor rotor.

The axially upstream second annular control member of at least one pair of second annular control members, the axially downstream second annular control member of the pair of second annular control members axially adjacent in an upstream direction and the annular casing member may be formed integrally.

The rotor and rotor blades may be formed from titanium.

The ratio of the thermal expansion coefficient of the at least one second annular control member to the thermal expansion coefficient of the first annular control member may be between 1 and 2 preferably between 1.3 and 1.4.

The first annular control member may be formed from a high temperature resistant steel, the second annular control member is formed from a nickel alloy.

The first and second annular control members may be formed from a high temperature resistant steel.

The first annular control member may comprise a plurality of circumferentially arranged segments.

BRIEF DESCRIPTION OF THE DRAWINGS

The present invention will be more fully described by way of example with reference to the accompanying drawings in which.

DETAILED DESCRIPTION OF THE PREFERRED EMBODIMENTS

Figure 1:
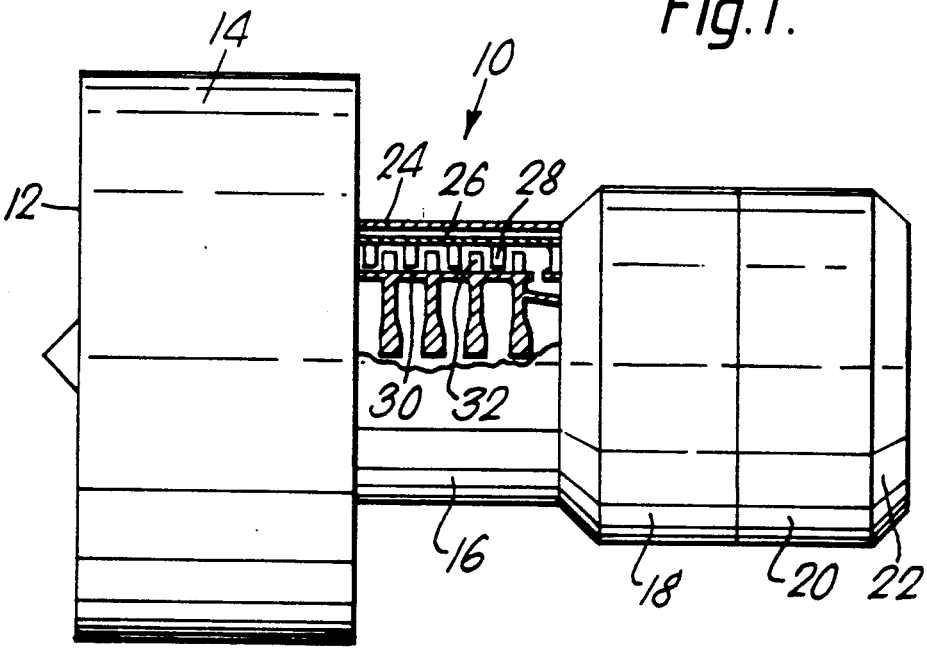
FIG. 1 is a partially cut away view of a gas turbine engine showing the present invention.

A turbofan gas turbine engine 10 is shown in FIG. 1 and comprises in axial flow series an intake 12, a fan 14, a compressor section 16, a combustion section 18, a turbine section 20 and an exhaust nozzle 22.

The gas turbine engine 10 operates quite conventionally and its operation will not be discussed herein.

Figure 3:
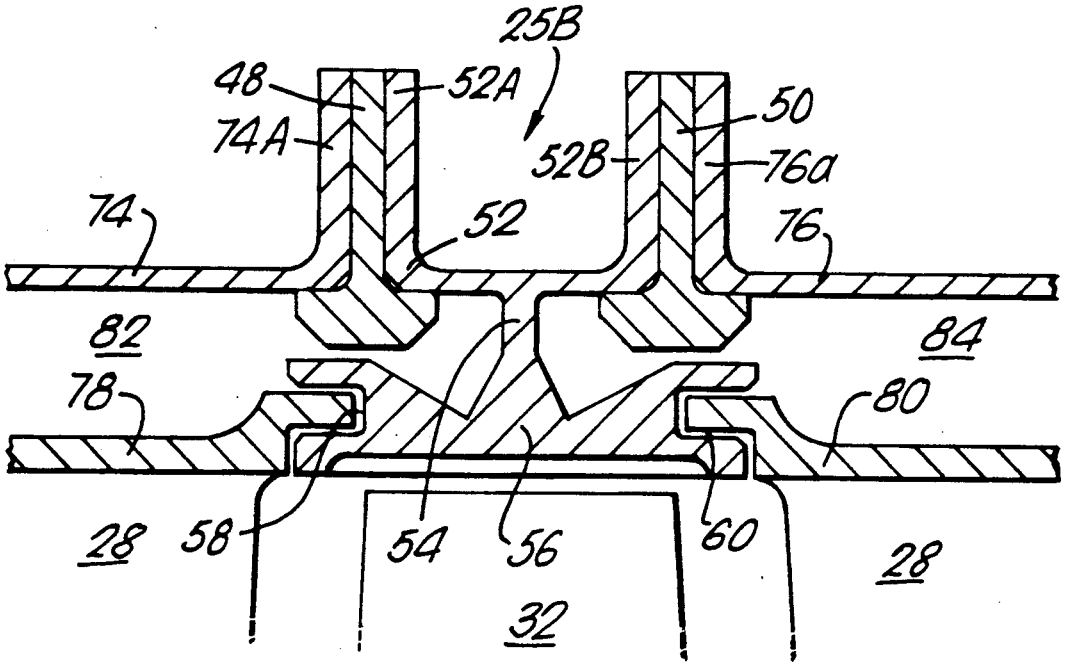
FIG. 3 shows a further enlarged cross-sectional view of part of the embodiment in FIG. 2.
Figure 2:
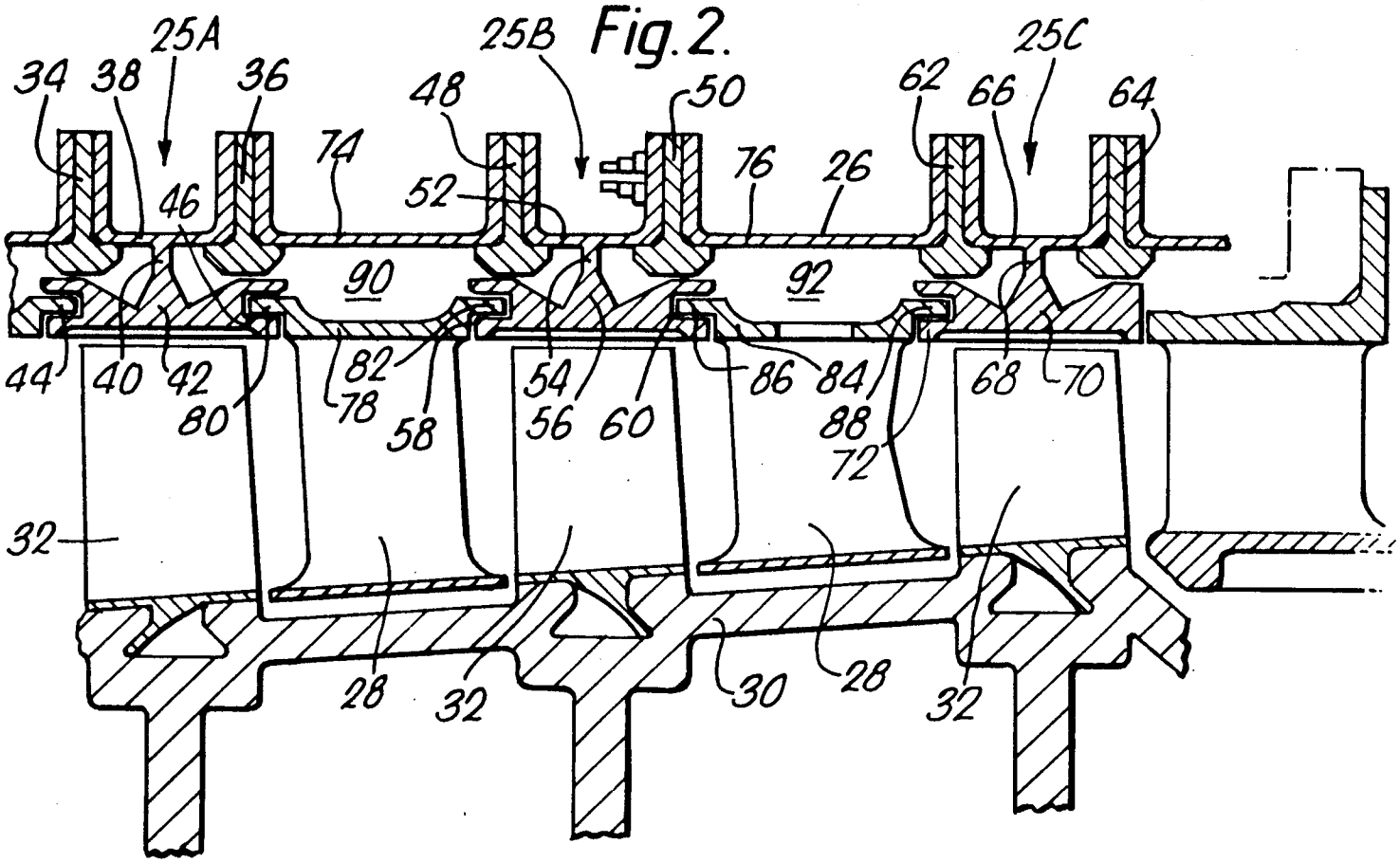
FIG. 2 shows an enlarged cross-sectional view in greater detail of the embodiment shown in FIG. 1.

A part of the compressor section 16 is shown more clearly with reference also to FIGS. 2 and 3, and comprises an outer stator casing 24 and an inner stator casing 26 which is positioned coaxially within the outer stator casing 24. The inner casing 26 carries a plurality of stages of stator vanes 28. The stages of stator vanes 28 are spaced axially. A compressor rotor 30 is rotatably mounted coaxially within the inner casing 26 by bearings (not shown), and the compressor rotor 30 has a plurality of stages of circumferentially arranged radially outwardly extending rotor blades 32. The stages of rotor blades are spaced axially and are arranged axially alternately with the stator vanes 28.

A number of blade tip clearance control arrangements 25A, 25B and 25C are shown in FIGS. 2 and 3. The intermediate blade tip clearance control arrangement 25B comprises a first annular control member 56 which is spaced radially from the tips of one of the stages of rotor blades 32 by a relatively small clearance, the first annular control member 56 defines a portion of the flowpath of the gas, air, through the compressor section 16. The first annular control member 56 is formed from a material having a relatively low expansion coefficient.

The first annular control member 56 is positioned coaxially with and radially inwardly of a pair of second annular control members 48,50, and the first annular control member 56 is supported by the second annular control members 48,50 by a radially resilient annular support member 52. The ends of the resilient annular support member 52 have radially extending flanges by means of which the resilient annular support member is secured to the second annular control members 48,50 by bolted joint arrangements, or other suitable joining means.

The first annular control member 56 is connected to the resilient annular support member 52 by a radially extending annular connecting member 54, the annular connection member 54 is secured to the mid portion of the resilient annular support member 52. Preferably the first annular control member 56, the annular connecting member 54 and the resilient annular support member 52 are formed integrally.

The second annular control members 48,50 are formed from a material having a relatively high thermal expansion coefficient.

The upstream blade tip clearance control arrangement 25A comprises a first annular control member 42 which is spaced radially from the tips of an upstream stage of rotor blades 32 by a small clearance, the first annular control member 42 defines a portion of the flowpath of the gas, air, through the compressor section 16. The first annular control member 42 is formed from a material having a relatively low thermal expansion coefficient.

The first annular control member 42 is positioned coaxially with and radially inwardly of a pair of second annular control members 34,36 and the first annular control member 42 is supported by the second annular control members 34,36 by a radially resilient annular support member 38. The ends of the resilient annular support member 38 have radially extending flanges by means of which the resilient annular support member is secured to the second annular control members 34,36 by a bolted joint arrangement, or again any other suitable joining means.

The first annular control member 42 is connected to the resilient annular support member 38 by a radially extending annular connecting member 40, the annular connecting member 40 is secured to the mid portion of the resilient annular support member 38. The first annular control member 42, the annular connecting member 40 and the resilient annular support member 38 are formed integrally.

The second annular control members 34,36 are formed from a material having a relatively high expansion coefficient.

Similarly the downstream blade tip clearance control arrangement 25C comprises a first annular control member 70, a pair of second annular control members 62,64, a radially resilient annular support member 66 and a radially extending annular connecting member 68.

The first annular control member 70 is formed from a material having a relatively low expansion coefficient, and the second annular control members 62,64 are formed from a material having a relatively high expansion coefficient.

The first annular control member 70, the annular connecting member 68 and the resilient annular support member 66 are also formed integrally.

Generally the inner casing 26 comprises the second annular control members 34,36 and resilient annular support member 38 of the upstream blade tip clearance control 25A, the second annular control members 48,50 and resilient annular support member 52 of the intermediate blade tip clearance control 25B and the second annular control members 62,64 and resilient annular support member 66 of the downstream blade tip clearance control 26C.

The upstream second annular control member 48 of the pair of second annular control members 48,50 of the intermediate blade tip clearance control 25B is secured to the downstream second annular control member 36 of the pair of second annular control members 34,36 of the upstream blade tip clearance control 25A by an annular casing member 74. Similarly the upstream second annular control member 62 of the pair of second annular control members 62,64 of the downstream blade tip clearance control 25C is secured to the downstream second annular control member 50 of the pair of second annular control members 48,50 of the intermediate blade tip clearance control 25B by a second annular casing member 76. Projections 51A and 51B represent nuts into which bolts are threaded to secure second annular control member 50 to a portion of radially resilient member 52.

The first annular control members 42,56 and 70 of the blade tip clearance control arrangements 25A,25B and 25C are arranged to carry the stages of stator vanes 28. The first annular control member 42 is provided with annular recesses 44 and 46 on its upstream and downstream faces, similarly first annular control member 56 has annular recesses 58 and 60 on its upstream and downstream faces and first annular control member 70 has an annular recess 72 on its upstream face. The outer platforms 78 and 84 of the stator vanes 28 have axially extending feet 80,82 and 86,88 which fit into the annular recesses 46,58 and 60,72 to retain the stator vanes 28.

Figure 6:
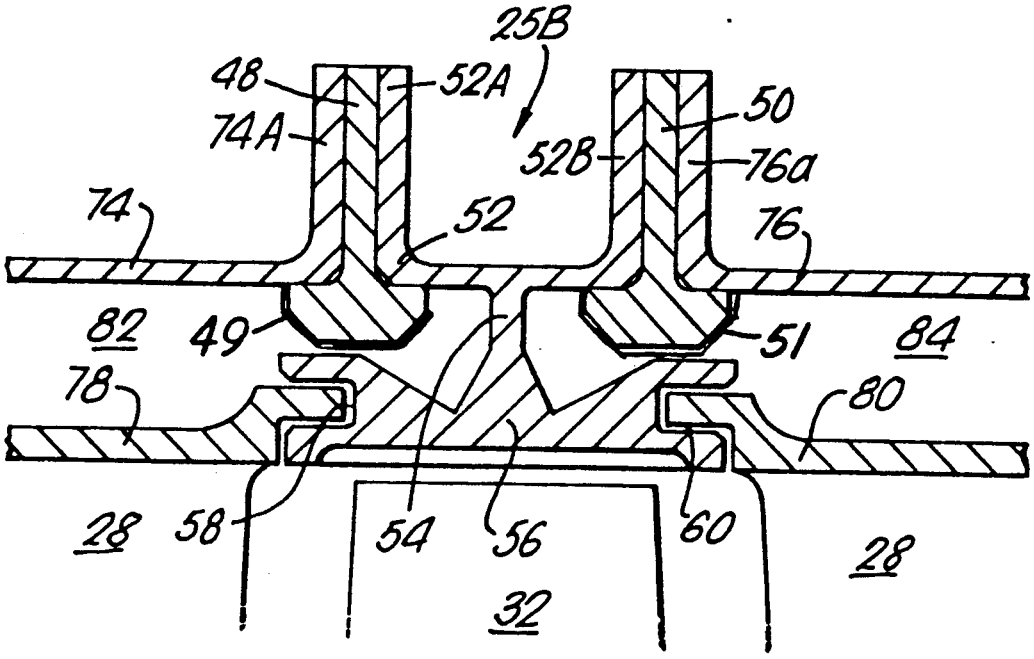
FIG. 6 shows insulating coatings on the second annular control members.

An annular chamber 90 is formed radially between the resilient annular support member 38, the second annular control member 36, the annular casing member 74, the second annular control member 48, the resilient annular support member 52 and the first annular control member 42, the platform 78 and the first annular control member 56. Similarly a second annular chamber 92 is formed radially between the resilient annular support member 52, the second annular control member 50, the second annular casing member 76, the second annular control member 62, the resilient annular support member 66 and the first annular control member 56, the platform 84 and the first annular control member 70. The annular chambers 90 and 92 are filled with an insulating material, for example air or other suitable material. As shown in FIG. 6, the second annular control members 48 and 50 may be provided with insulating coatings 49 and 51, respectively.

As shown in FIG. 3, the blade tip clearance control 25B comprises two principally different thermally responsive annular control members 48,50 and 56. The first annular control member 56 comes into direct contact with the main gas stream and is heated almost immediately. The first annular control member 56 is effectively suspended from the two second annular control members 48,50 by the resilient annular support member 52. Heat transfer to the second annular control members 48,50 may be limited to thermal conduction from the resilient annular support member 52 at the face contacts of the flange points. The heat conducted from the first annular control member 56 is choked or restricted by the connecting member 54.

In operation, as shown in FIG. 3, when heat is applied, i.e. during an engine acceleration event, the first annular control member 56 initially expands rapidly and the second annular control members 48,50 expand slowly, but the resilient annular support member 52 bends radially outwardly to allow for the difference in thermal expansion rates of the control members. The first annular control member 56 expands in accordance with its own rate of thermal expansion, but expands against the combined resilience of the resilient annular support member 52 and the second annular control members 48,50, which control the rate of expansion of the first annular control member 56. At some point the first annular control member 56 becomes fully thermally expanded, i.e. it reaches its maximum thermal radial displacement, but the second control members 48,50, because of their higher coefficient of expansion and slower response rate, continue to expand thermally. Eventually the second annular control members 48,50 expand radially by more than the maximum thermal radial displacement of the first annular control member 56, and thus the first annular control member 56 is caused to expand further relatively slowly in accordance with the rate of expansion of the second annular control member 48,50 because of the interconnection between the second annular control members 48,50 and the first annular control member 56. During the second phase of thermal expansion the resilient annular support member 52 is caused to become bent radially inwardly due to the resistance to further expansion of the first annular control member 56. At some point the second control members 48,50 become fully thermally expanded, i.e. reach their maximum thermal radial displacement.

When heat is reduced i.e. during an engine deceleration event, the first annular control member 56 initially contracts rapidly and the resilient annular support member 52 bends radially inwardly to allow for the difference in thermal expansion rates of the control members. The first annular control member 56 contracts in accordance with its own rate of thermal contraction, but contracts against the combined resilience of the resilient annular support member 52 and the second annular control members 48,50 which control the rate of contraction of the first annular control member 56. The resilience of the resilient annular support member 52 prevents the first annular control member 56 from contracting fully thermally, but as the second control members 48,50 contract the first control member 56 is allowed to contract slowly in accordance with the rate of contraction of the second annular control members 48,50.

Figure 4:
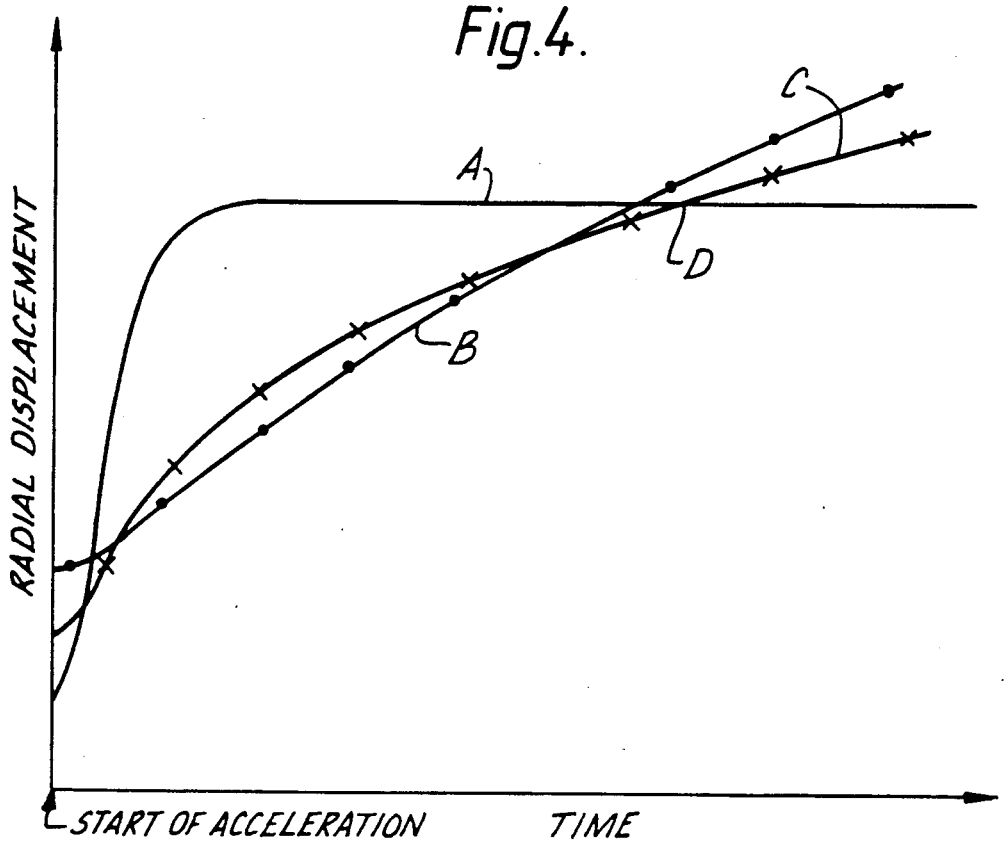
FIG. 4 shows a graph of radial displacement against time for the present invention.

The radial displacements of the first annular control member 56 and second annular control members 48,50 with time for an acceleration are shown in FIG. 4. Curve A shows the free radial displacement of the first annular control member 56 with time during an acceleration, it can be seen that the first annular control member expands initially rapidly and then remains substantially constant when it reaches its maximum thermal radial displacement. Curve B shows the free radial displacement of the second annular control members 48,50 with time during an acceleration, it can be seen that the second annular control members 48,50 expand relatively slowly throughout the time period shown. Curve C shows the effect on the first annular control member 56 on coupling it to the second annular control members 48,50 by the resilient annular support member 52, it can be seen that the first annular control member initially expands relatively quickly and then expands relatively slowly in accordance with the second annular control members. Beyond point D the first annular control member is caused to expand beyond its natural fully thermally expanded condition i.e. beyond its maximum thermal radial displacement.

As an example, a fast response casing arrangement of the prior art will, in general, enable a small initial cold build blade tip clearance to be defined at the expense of a transient overshoot, i.e. a large transient blade tip clearance, when heat is applied in operation. On the other hand, with a slow response casing arrangement of the prior art a large initial cold build blade tip clearance is required. This large clearance does not fully reduce until well into the take-off part of the gas turbine engine operating cycle.

One of the objectives of the present invention is to attain at least a dual rate radial displacement against time profile in operation. The dual rate radial displacement against time profile comprises a relatively fast rate of expansion in the initial phase and a more gradual but continuous expansion in a final phase of operation. Even though a passive blade tip clearance control is not able to match the almost instantaneous response of the rotor under centrifugal loading, the present invention enables a relatively small initial cold build blade tip clearance to be defined with considerably reduced risk of blade tip contact and no risk of transient overshoot. The present invention therefor provides a significant increase in transient surge margin when it is needed most i.e. for good manoeuverability. The multi-rate response concept ensures a more optimum matching with rotor rim growth producing a small blade tip clearance for increased efficiency at various stabilised operating conditions.

Figure 5:
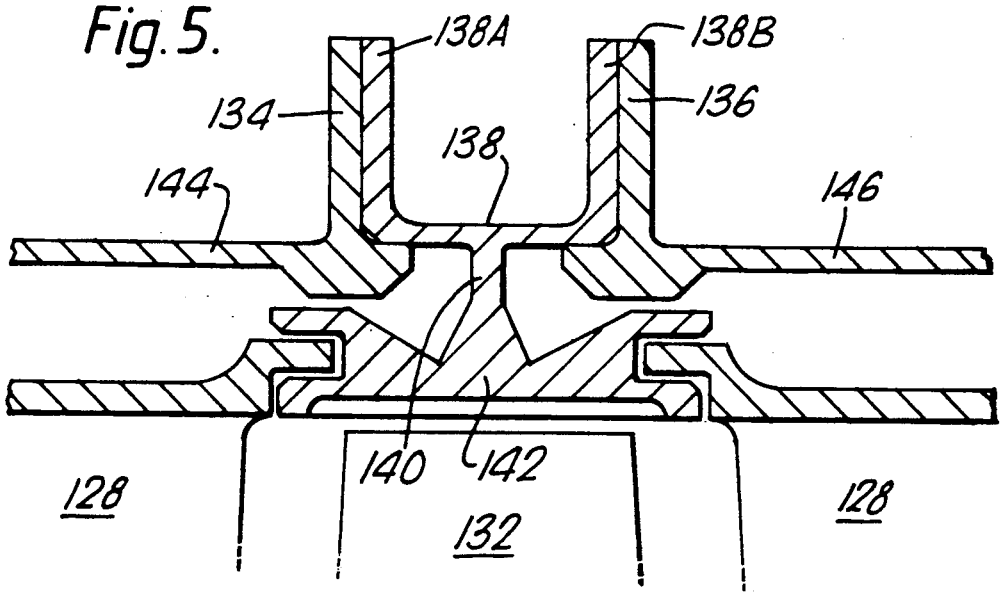
FIG. 5 shows an enlarged cross-sectional view to the same scale as FIG. 3 of a further embodiment of the present invention.

The embodiment of a blade tip clearance control arrangement shown in FIG. 5 is substantially the same as that shown in FIGS. 2 and 3. It again comprises two different thermally responsive annular control members 134,136 and 142. The first annular control member 142 comes into direct contact with the main gas stream and is heated almost immediately. The first annular control member 142 is suspended from the two second annular control members 134,136 by a resilient annular support member 138. The major difference between this embodiment and that in FIGS. 2 and 3 is that the second annular control member 134 is formed integral with an annular casing member 144 and the second annular control member 136 is formed integral with an annular casing member 146. In effect the flanges of the annular casing members form the second annular control members.

The advantage of this arrangement over the embodiment shown in FIGS. 2 and 3 is that there is a reduction in the number of components forming the casing 26, and there is a weight reduction. However the arrangement is equally effective at controlling the blade tip clearance as the embodiments in FIGS. 2 and 3.

Although the radial displacement of the first annular control member, and hence blade tip clearance, is principally controlled by the interaction of the first and second annular control members, a multi-rate radial time displacement against time profile may be achieved by suitable selection of materials with respect to thermal expansions and thermal diffusivities, thermal inertias and radial structural resilience of the first and second annular control members.

The ratio of thermal expansion coefficient of the second annular control member to the thermal expansion coefficient of the first annular control member is selected to be between 1.0 and 2.0, and preferably is selected to be between 1.3 and 1.4.

The radially resilient annular support member further controls the interaction between the first and second annular control members by its own thermal inertia and structural resilience.

The axial length and the thickness of the resilient annular support member control the stiffness between the first annular control member and the second annular control member. The resilient annular support controls the rate of expansion/contraction of the first annular control member. The material for the resilient annular support member, and the axial length and thickness are selected to give the desired characteristics.

For example the axial length of the resilient annular support member is approximately 1 inch=2.5 cm, and the thickness is 1/10 inch=0.25 cm.

As an example of the invention applied to a titanium high pressure compressor rotor, with titanium rotor blades, the first annular control rings and the resilient annular support ring are manufactured from a steel with high temperature and creep resistant properties sold under the trade name FV535, and the second annular control rings are manufactured from a nickel base alloy sold under the trade name INCO 901.

FV535 has a nominal composition of 10% Chromium, 6% Cobalt, 0.8% Molybdenum, and the balance is Iron. INCO 901 has a nominal composition of 35% Iron, 12% Chromium, 6% Molybdenum, 3% Titanium and the balance is Nickel with minor addition of Cobalt.

A further example of the invention applied to a titanium high pressure compressor rotor with titanium rotor blades, the first annular control ring, the resilient annular support ring and the second annular control rings are manufactured from the steel sold under the trade name FV535. The advantage of using the all steel arrangement is that of a reduction in manufacturing costs.

For lower temperature and lower pressure stages of the high pressure compressor or a low pressure compressor a low temperature steel sold under the trade name Jethete may be used.

The optimum blade tip clearance is 0.25 mm for a blade with a 1 inch=2.5 cm blade true chord; the invention is capable of controlling the blade tip clearance between the range of 0.15 mm - 0.30 mm at high power conditions.

The invention controls the blade tip clearance to improve the efficiency and surge margin of the compressor.

The first control member, as described with reference to the embodiments, is a completely annular member, this allows the first control member to expand or contract thermally equally in all radial directions. The first control member may comprise a plurality of circumferentially arranged segments, which together form a complete annulus. However, the use of the segmented first control member is not the preferred solution because in operation the segments of the segmented first control member expand or contract thermally in a circumferential direction in addition to the radial direction. The segmented first control member therefore does not respond as quickly as the fully annular first control member to match fast transient growth of the rotor rim. The segmented first control member will also suffer from leakage of gas between adjacent segments.

Although the description and drawings have described the invention with reference to a compressor the invention is equally applicable to a turbine of a gas turbine engine.

I claim:

1. A blade tip clearance control arrangement for a gas turbine engine comprising a rotor and a stator, the rotor having at least one stage of circumferentially arranged radially extending rotor blades, the rotor blades having tips, the stator comprising a first annular control member, at least one second annular control member and a radially resilient annular support member, the first annular control member having a relatively rapid response such that it expands or contracts quickly in accordance with a temperature variation, the first annular member being formed from a material having a relatively low coefficient of thermal expansion, the first annular control member being spaced radially from the blade tips by a clearance and defining a portion of a flowpath through the gas turbine engine, the at least one second annular control member having a relatively slow response rate such that it expands or contracts slowly in accordance with a temperature variation, the second annular control member being formed from a material having a relatively high coefficient of thermal expansion, the first annular control member being arranged coaxially with and radially inwardly of the second annular control member, the radially resilient annular support member secured immovably to both the first annular control member and the second annular control member whereby the first annular control member initially expands relatively rapidly in a first phase of thermal expansion in accordance with the rate of expansion of the first annular control member against the combined resilience of the resilient annular support member and the second annular control member until the first annular control member is fully thermally expanded, the first annular control member being caused to expand relatively slowly in a second phase of thermal expansion in accordance with the rate of expansion of the second annular control member by the resilience of the resilient annular support member, the first annular control member initially contracting relatively rapidly in a first phase of thermal contraction in accordance with the rate of contraction of the first annular control member against the combined resilience of the resilient annular support member and the second annular control member, the first annular control member being caused to contract relatively slowly in a second phase of thermal contraction in accordance with the rate of contraction of the second annular control member by the resilience of the resilient annular support member.

2. The blade tip clearance control arrangement as claimed in claim 1 in which two second annular control members are axially spaced, the first annular control member is arranged coaxially with and radially inwardly of the second annular control members, the radially resilient annular support member is secured immovably to both the first annular control member and the second annular control members, the radially resilient annular support member has axial ends and a mid portion between the two axial ends, the axial ends of the resilient annular support member are secured to the second annular control members, and the first annular control member is connected to the resilient annular support member by connection means substantially at the mid portion of the resilient annular support member.

3. The blade tip clearance control arrangement as claimed in claim 2 in which the first annular control member, the resilient annular support member, and the connection means are integrally formed.

4. The blade tip clearance control arrangement as claimed in claim 2 wherein the rotor comprises a plurality of axially spaced stages of the rotor blades, and wherein the stator comprises a plurality of the first annular control members each one of which is spaced radially from the blade tips of a respective one of the stages of rotor blades by a clearance, each first annular control member being arranged coaxially with and radially inwardly of a respective pair of second annular control members, a respective resilient annular support member being arranged to interconnect each first annular control member and the respective pair of second annular control members, each radially resilient support member having axial ends and a mid portion between the two ends, the axial ends of each resilient annular support member being secured to the respective pair of second annular control members, each first annular control member being connected to the respective resilient annular support member by connection means substantially at the mid portion of the resilient annular support member.

5. The blade tip clearance control arrangement as claimed in claim 4 in which each pair of second annular control members comprises an axially upstream second annular control member and an axially downstream second annular control member, the axially upstream second annular control member of at least one pair of second annular control members is secured to the axially downstream second annular control member of the pair of second annular control members axially adjacent in an upstream direction by an annular casing member such that the second annular control members, the resilient annular members and the annular casing member define a stator casing.

6. The blade tip clearance control arrangement as claimed in claim 5 in which a stage of stator vanes is positioned axially between adjacent stages of rotor blades, each stage of stator vanes having an upstream end and a downstream end, each stage of stator vanes being secured at their upstream end and downstream end to said first annular control members.

7. The blade tip clearance control arrangement as claimed in claim 5 in which the axially upstream second annular control member of at least one pair of second annular control members, the axially downstream second annular control member of the pair of second annular control member axially adjacent in an upstream direction and the annular casing member are formed integrally.

8. The blade tip clearance control arrangement as claimed in claim 1 in which the ratio of the thermal expansion coefficient of the at least one second annular control member to the thermal expansion coefficient of the first annular control member is between 1 and 2.

9. The blade tip clearance control arrangement as claimed in claim 8 in which the ratio of the thermal expansion coefficient of the at least one second annular control member to the thermal expansion coefficient of the first annular control member is between 1.3 and 1.4.

10. The blade tip clearance control arrangement as claimed in claim 1 in which the second control member has an insulating coating.

11. The blade tip clearance control arrangement as claimed in claim 1 in which the rotor is a compressor rotor.

12. The blade tip clearance control arrangement as claimed in claim 11 in which the rotor and rotor blades are formed from titanium.

13. The blade tip clearance control arrangement as claimed in claim 12 in which the first annular control member is formed from a high temperature resistant steel, the second annular control member is formed from a nickel alloy.

14. The blade tip clearance control arrangement as claimed in claim 12 in which the first and second annular control members are formed from a high temperature resistant steel.

15. The blade tip clearance control arrangement as claimed in claim 2 in which the radially resilient annular support member is formed from a selected material and has a selected axial length and a selected thickness to control the expansion of the first annular control member.

16. The blade tip clearance control arrangement for a gas turbine engine comprising a rotor and a stator, the rotor having at least one stage of circumferentially arranged radially extending rotor blades, the rotor blades having tips, the stator comprising a first annular control member, at least one second annular control member and a radially resilient annular support member secured immovably to both said first annular control member and said at least one second control member, the first annular control member having a relatively rapid response rate such that it expands or contracts quickly in accordance with a temperature variation, the first annular member being formed from a material having a relatively low coefficient of thermal expansion, the first annular control member being spaced radially from the blade tips by a clearance and defining a portion of a flowpath through the gas turbine engine, the at least one second annular control member having a relatively slow response rate such that it expands or contracts slowly in accordance with a temperature variation, the second annular control member being formed from a material having a relatively high coefficient of thermal expansion, the first annular control member being arranged coaxially with and radially inwardly of the second annular control member, the radially resilient annular support member being arranged to interconnect the first annular control member and the second annular control member whereby the first annular control member initially expands relatively rapidly in a first phase of thermal expansion in accordance with the rate of expansion of the first annular control member against the combined resilience of the resilient annular support member and the second annular control member until the first annular control member is fully thermally expanded, the first annular control member expanding relatively slowly in a second phase of thermal expansion in accordance with the rate of expansion of the second annular control member by the resilience of the resilient annular support member, the first annular control member initially contracts relatively rapidly in a first phase of thermal contraction in accordance with the rate of contraction of the first annular control member against the combined resilience of the resilient annular support member and the second annular control member, the first annular control member contracting relatively slowly in a second phase of thermal contraction in accordance with the rate of contraction of the second annular control member by the resilience of the resilient annular support member, wherein two second annular control members are axially spaced, the first annular control member being arranged coaxially with and radially inwardly of the second annular control members, the radially resilient annular support member being arranged to interconnect the first annular control member and the second annular control members, the radially resilient annular support member having axial ends and a mid portion between the two axial ends, the axial ends of the resilient annular support member being secured to the second annular control members, the first annular control member being connected to the resilient annular support member by connection means substantially at the mid portion of the resilient annular support member, wherein the rotor comprises a plurality of axially spaced stages of the rotor blades, and wherein the stator comprises a plurality of the first annular control members each one of which is spaced radially from the blade tips of a respective one of the stages of rotor blades by a clearance, each first annular control member being arranged coaxially with and radially inwardly of a respective pair of second annular control members, a respective resilient annular support member being arranged to interconnect each first annular control member and the respective pair of second annular control members, each radially resilient support member having axial ends and a mid portion between the two ends, the axial ends of each resilient annular support member being secured to the respective pair of second annular control members, each first annular control member being connected to the respective resilient annular support member by connection means substantially at the mid portion of the resilient annular support member, wherein each pair of second annular control members comprises an axially upstream second annular control member and an axially downstream second annular control member, the axially upstream second annular control member of at least one pair of second annular control members being secured to the axially downstream second annular control member of the pair of second annular control members axially adjacent in an upstream direction by an annular casing member such that the second annular control members, the resilient annular members and the annular casing member define a stator casing, the axially upstream second annular control member of at least one pair of second annular control members, the axially downstream second annular control member of the pair of second annular control members axially adjacent in an upstream direction and the annular casing member being formed integrally.

17. A blade tip clearance control structure in a gas turbine engine of the type having a rotor mounted for rotation about an axis and a plurality of radially extending blades mounted on the rotor for rotation therewith, the clearance control structure comprising:

a first annular control member having a surface extending a selected axial length confronting the blade tips and spaced therefrom to define a gas flowpath therebetween, said first annular control member fabricated from a material having a first coefficient of expansion and a first expansion-and-contraction response to temperature variation;

a second annular control member radially outward of said first annular control member and fabricated from a material having a second coefficient of expansion and a second expansion-and-contraction response to temperature variation;

a radially resilient annular support member resiliently interconnecting said first and second annular control members and having a portion thereof fixed integrally to said first annular control member and another portion thereof fixed integrally to said second annular control member, said first coefficient of expansion being lower than that of said second coefficient of expansion and said first expansion-and-contraction response to temperature being more rapid than said second expansion-and-contraction response.

18. The blade tip clearance structure of claim 17, wherein the ratio of the second to the first coefficient of expansion is between one and two.

19. The blade tip clearance structure of claim 18, wherein the ratio of the second to the first coefficient of expansion is between 1.3 and 1.4.

20. In a gas turbine engine of the type having a rotor mounted for rotation about an axis, a plurality of radially extending blades mounted on the rotor for rotation therewith about the axis, and a support casing surrounding the rotor, a temperature-responsive blade tip clearance structure connected to the support casing and radially spaced from and confronting the blade tips, the clearance control structure comprising:

a first annular control member having a surface extending a selected axial length confronting the blade tips and spaced radially therewith to define a gas flowpath therebetween, said first annular control member fabricated from a material having a first coefficient of expansion and a first expansion-and-contraction response to temperature variation;

a pair of second annular control members radially outward of said first annular control member and axially spaced relative one another, said second annular control members fabricated from a material having a second coefficient of expansion and a second expansion-and-contraction response to temperature variation;

an axially extending radially resilient annular support member having axially spaced portions thereof fixed integrally to a respective one of said second annular control members; said resilient annular support member connected intermediate its axially spaced portions to a portion of said first annular control member intermediate the axial ends thereof to resiliently interconnect said first and second annular control members, said first coefficient of expansion being lower than that of said second coefficient of expansion and said first expansion-and-contraction response to temperature being more rapid than said second expansion-and-contraction response.

21. The blade tip clearance structure of claim 20, further comprising:

a radially extending connecting member interconnecting said resilient annular support member intermediate its ends and said first annular control member intermediate its ends, one of said second annular control members located on opposite sides of said radially extending connecting member.

22. The blade tip clearance structure of claim 20, wherein the ratio of the second to the first coefficient of expansion is between one and two.

23. The blade tip clearance structure of claim 20, wherein the ratio of the second to the first coefficient of expansion is between 1.3 and 1.4.

24. The blade tip clearance structure of claim 20, wherein the the axially spaced portions of the resilient annular support member are fixed integrally to their respective ones of said second annular control members by threaded fasteners.

* * * * *